US009915084B1

(12) United States Patent
Smith et al.

(10) Patent No.: US 9,915,084 B1
(45) Date of Patent: Mar. 13, 2018

(54) LOCKING MECHANISM FOR SAFE AND OTHER SECURE STORAGE APPARATUS

(71) Applicant: FireKing Security Products, LLC., New Albany, IN (US)

(72) Inventors: Michael J. Smith, Scottsburg, IN (US); Daniel Jones, Elizabeth, IN (US)

(73) Assignee: FireKing Security Products, LLC, New, IN (US)

( * ) Notice: Subject to any disclaimer, the term of this patent is extended or adjusted under 35 U.S.C. 154(b) by 0 days.

(21) Appl. No.: 15/297,520

(22) Filed: Oct. 19, 2016

(51) Int. Cl.

| | |
|---|---|
| ***E05B 65/00*** | (2006.01) |
| ***E05B 17/20*** | (2006.01) |
| ***E05C 3/16*** | (2006.01) |
| ***E05B 63/20*** | (2006.01) |
| ***E05C 9/00*** | (2006.01) |
| ***E05B 47/06*** | (2006.01) |
| ***E05B 63/12*** | (2006.01) |
| ***E05C 19/12*** | (2006.01) |
| ***E05C 3/34*** | (2006.01) |
| ***E05B 65/08*** | (2006.01) |
| ***E05G 1/04*** | (2006.01) |
| ***E05C 9/18*** | (2006.01) |

(52) U.S. Cl.
CPC ..... *E05B 65/0075* (2013.01); *E05B 17/2034* (2013.01); *E05B 47/0607* (2013.01); *E05B 63/12* (2013.01); *E05B 63/20* (2013.01); *E05B 65/0811* (2013.01); *E05C 3/16* (2013.01); *E05C 3/34* (2013.01); *E05C 9/00* (2013.01); *E05C 9/1875* (2013.01); *E05C 19/12* (2013.01); *E05G 1/04* (2013.01)

(58) Field of Classification Search
CPC .. E05G 1/00; E05G 1/02; E05G 1/026; E05G 1/04; E05B 17/20; E05B 17/2007; E05B 17/203; E05B 17/2034; E05B 17/2088; E05B 63/0013; E05B 63/12; E05B 63/123; E05B 63/127; E05B 65/0075; E05B 65/0811; E05B 65/0847; E05B 65/0858; E05C 3/30; E05C 3/34; E05C 3/167; E05C 19/10; E05C 19/12; E05C 9/08; E05C 9/18; E05C 9/1875; E05C 9/1891
See application file for complete search history.

(56) References Cited

U.S. PATENT DOCUMENTS

| | | | | |
|---|---|---|---|---|
| 3,899,201 | A * | 8/1975 | Paioletti | E05B 65/0858 292/106 |
| 5,134,870 | A * | 8/1992 | Uyeda | E05B 47/0002 70/277 |
| 5,142,890 | A * | 9/1992 | Uyeda | E05B 47/0002 70/229 |
| 6,679,087 | B2 * | 1/2004 | Suggs | E05B 65/0075 109/59 R |
| 6,907,830 | B2 * | 6/2005 | Guinan | E05B 63/0004 109/24.1 |
| 7,210,712 | B2 * | 5/2007 | Artsiely | E05B 17/2007 292/109 |

(Continued)

*Primary Examiner* — Christopher J Boswell
(74) *Attorney, Agent, or Firm* — Great Lakes Intellectual Property, PLLC

(57) ABSTRACT

A locking mechanism suitable for use with a door or other entry point is contemplated. The locking mechanism may include cams, levers or other features operable to facilitate securing the door against prying, wedging and related techniques intended to compromise secure by physically separating the door from a door frame or other support structure.

18 Claims, 6 Drawing Sheets

(56) References Cited

U.S. PATENT DOCUMENTS

| | | | | |
|---|---|---|---|---|
| 8,261,586 | B2 * | 9/2012 | Gartner | E05B 47/0002 292/201 |
| 8,347,665 | B2 * | 1/2013 | Rasmussen | E05B 47/0673 109/59 R |
| 8,899,635 | B2 * | 12/2014 | Nakanishi | E05B 63/0056 292/194 |
| 9,410,350 | B2 * | 8/2016 | Stendal | E05B 15/101 |
| 9,410,355 | B2 * | 8/2016 | Suggs | E05G 1/04 |
| 2008/0314100 | A1 * | 12/2008 | Min | E05B 47/0012 70/278.1 |
| 2012/0146346 | A1 * | 6/2012 | Hagemeyer | E05B 63/143 292/217 |

* cited by examiner (Section A-A)

(Section A-A)

LOCKING MECHANISM FOR SAFE AND OTHER SECURE STORAGE APPARATUS

TECHNICAL FIELD

The present invention relates to locking mechanisms operable to facilitate securing a door or other entry point, such as but not necessary limited to locking mechanisms having capabilities to facilitate securing the door against prying, wedging and related techniques intended to compromise secure by physically separating the door from a door frame or other support structure.

BACKGROUND

FIG. 1 illustrates a safe 10 having a bolt-action locking mechanism 12 of the type employing mechanically and/or electrically actuated locking bolts 14, 16. The locking bolts 14, 16 are shown as being operable to retract from a sidewall 18 to an unlocked position (not shown) to permit a door 20 to be opened and to engage with the sidewall 18 in a locked position (shown) to prevent the door 20 from being opened, such as in the manner described in U.S. Pat. No. 8,794,420, entitled Secure Storage Apparatus, the disclosure of which is hereby incorporated by reference in its entirety herein. Any safe having a bolt-action locking mechanism or other locking mechanism with vulnerabilities similar to the illustrated bolt-action locking mechanism 12, may be susceptible to break-ins of the type whereby a wedge 22 is forcefully driven into a seam 24 between the door 20 and the sidewall 18 (left-hand view) so as to induce a prying effect sufficient for generating a gap 26 between the sidewall 18 and the door 20 (right-hand view). The susceptibility to prying jeopardizes security of items kept within a storage area when the resulting gap 26 become sufficient to pry the sidewall 18 out of engagement with the locking bolts 14, 16 such that the door 20 can be opened while the locking mechanism 12 is in the locked position.

One non-limiting aspect of the present invention contemplates a locking mechanism of the type sufficient to facilitate thwarting security breaches using a wedge or other prying mechanisms intended to separate locking bolts or other security elements from sidewalls or other retaining features of the safe or entry point.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
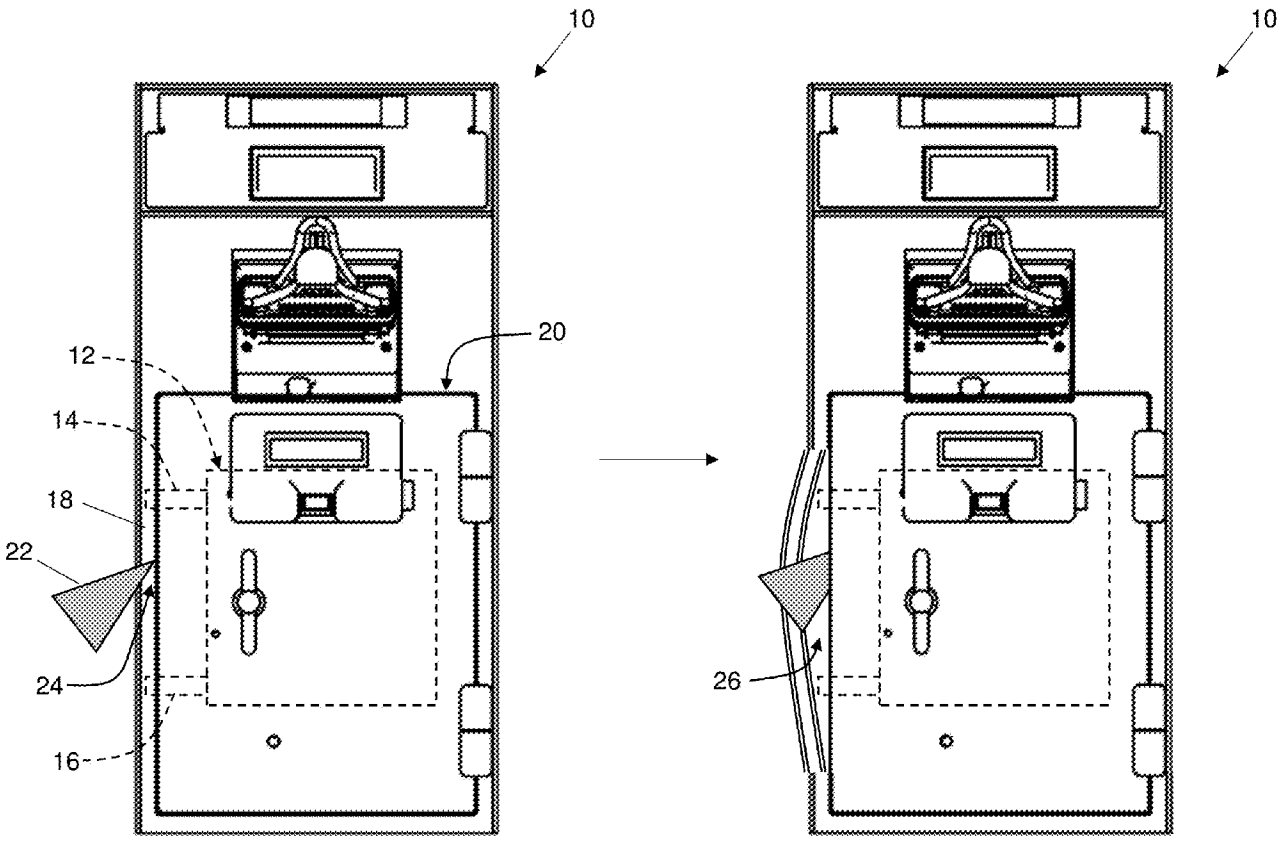
Fig. 1 (Prior Art)
FIG. 1 illustrates a safe having a bolt-action locking mechanism of the type employing mechanically and/or electrically actuated locking bolts.
Figure 2:
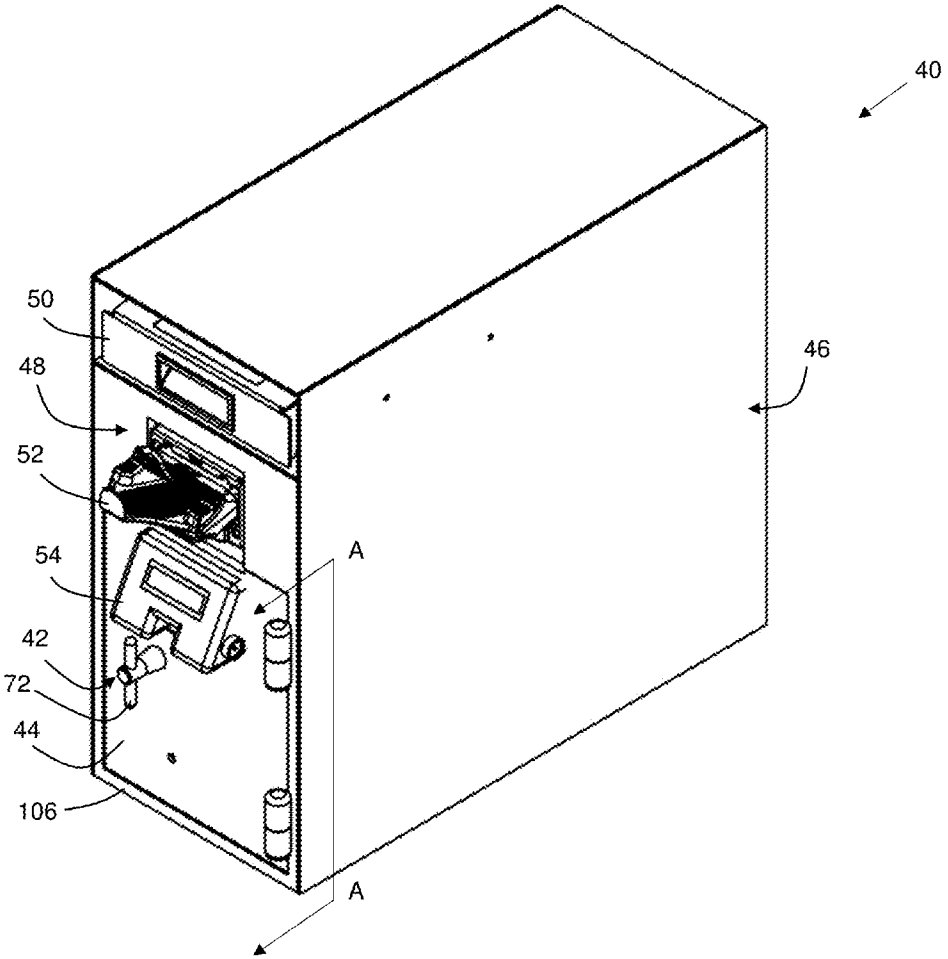
FIG. 2 illustrates a safe having a locking mechanism in accordance with one non-limiting aspect of the present invention.

FIG. 2 illustrates a safe 40 having a locking mechanism 42 in accordance with one non-limiting aspect of the present invention. The locking mechanism 42 is predominately described with respect to securing entry to the safe 40 via an exterior door 44 for exemplary purposes as the present invention fully contemplates its use and application in securing doors or other entry points included on devices other than safes, such as but not necessary limited to securing doors, windows, latches, covers, etc. used to control entry into buildings, rooms, bank vaults, compartments and the like. The present invention is believed to be particularly useful in securing safes against the above-described prying or wedging due to the locking mechanism 42 providing multiple points of engagements sufficient to thwart damaging a housing 46 or other component the safe 40 in a manner intended to pry the locking mechanism 42 into a position capable of compromising security. While not illustrated, the security provided with the locking mechanism 42 of the present invention may be further enhanced with use of an anti-prying device described in U.S. Pat. No. 6,923,127, entitled Anti-Prying Device For Use With A Safe, the disclosure of which is hereby incorporated by reference in its entirety herein.

The safe 40 may be considered as a secure storage apparatus configured to facilitate safekeeping of deposits, such as but not necessarily limited to deposits in the form of coins, paper currency, bills, documents, letters, boxes or other items that may be electro-mechanically delivered through an exterior input 48 for safekeeping within an interior storage location. The safe 40 is described with respect to including a pull-out control panel or human-machine interface (HMI) 50, a display and/or card reader 52 and a sorter or a bill validator 54 operable to receive and process paper currency for safekeeping, such as in the manner described in U.S. Ser. No. 14/532,145, entitled Note Verify, the disclosure of which is hereby incorporated by reference in its entirety herein, however other similar configurations may be used without deviating from the scope and contemplation of the present invention (e.g., vending machines, automated teller machines (ATMs), video game machines, etc.). The HMI 50 may include a network interface (not shown) sufficient to facilitate remote control and networking of the safe 40 and the safe 40 may be enclosed in a sleeve (not shown), such as in the manner described in U.S. patent application Ser. No. 13/648,503, entitled Mobile Validating System, the disclosure of which is hereby incorporated by reference in its entirety, and the applications and patents noted above.

Figure 3:
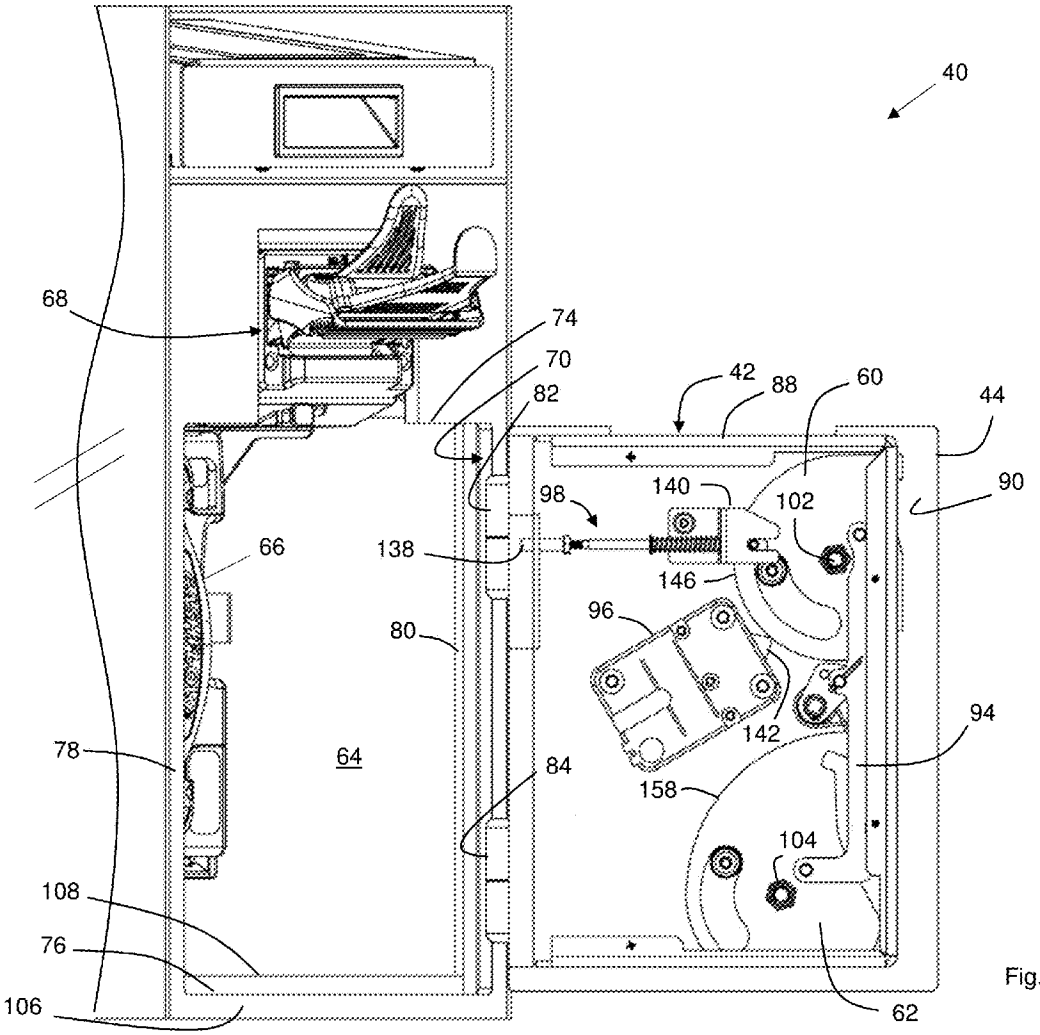
FIG. 3 illustrates a partial interior view of the safe when the door is an opened position and the locking mechanism is in a disengaged position in accordance with one non-limiting aspect of the present invention.
Figure 4:
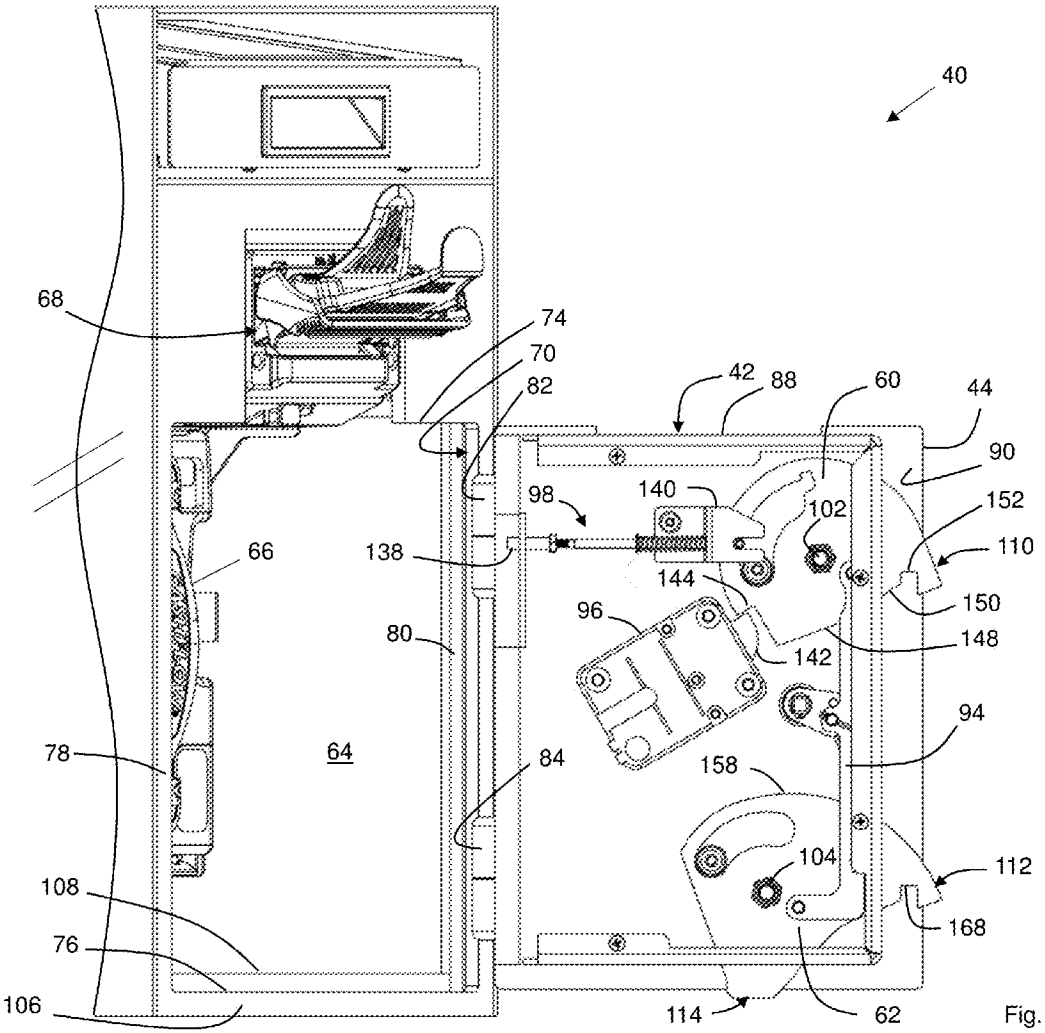
FIG. 4 illustrates the partial interior view of the safe when the door is in the opened position and the locking mechanism is in an engaged position in accordance with one non-limiting aspect of the present invention.

FIG. 3 illustrates a partial interior view of the safe 40 when the door 44 is an opened position and the locking mechanism 42 is in a disengaged position in accordance with one non-limiting aspect of the present invention. FIG. 4 illustrates the partial interior view of the safe 40 when the door 44 is in the opened position and the locking mechanism 42 is in an engaged position in accordance with one non-limiting aspect of the present invention. The illustrations are shown to demonstrate movement of first and second cams 60, 62 included as part of the locking mechanism 42 from the disengaged position to the engaged position, which is described in more detail below. A secure storage area 64 may be included within the safe 40 to store a cassette 66 that operates with a head 68 of the bill validator 52 to facilitate processing and safe storage of paper currency. The safe 40 may optionally be configured to facilitate servicing of the bill validator 52 while maintaining security of the currency kept within the storage cassette 66, e.g., while the door 44 is closed, and/or in accordance with the material incorporated by reference herein. The illustrated opened position made be generally characterized as occurring when positioning of the door 44 is sufficient to enable a teller or other individual/machine to remove the cassette 66 from the secure storage area 64 and/or at any other door position sufficient to compromise security of the cassette 66 or other items kept in the secure storage area 64.

The safe 40 is shown to be generally rectangular for exemplary non-limiting purposes as the present invention fully contemplates securing access through the door 44 or other entry point for devices having other shapes and configurations. The safe 40 may include a door frame 70 or other structure for defining an opening to the secure storage area 64 within which the door 44 is operable between the opened position (see FIGS. 3 and 4) and a closed position (see FIG. 2). The door 44 may be operable between the open and closed positions by a person pushing or pulling on a handle 72 (see FIG. 2) of the locking mechanism 42 and/or automatically with electro-mechanical actuation provided with a suitable actuator (not shown). The opening associated with the door frame 70 may correspond with a top wall 74 vertically spaced apart from a bottom wall 76 with horizontally spaced apart sidewalls 78, 80 extending therebetween. The door frame 70, particular when the present invention is utilized to secure access to rooms, vaults or other entry points having larger doors, the top wall 74 may be characterized as a door header, the bottom wall 76 may be characterized as a door sill and the sidewalls 78, 80 may be characterized as a door jamb or left and right door jambs. The door 44 is shown to be movable relative to the door frame 70 via first and second hinges 82, 84 such that the door 44 is rotated thereabout between the open and closed positions. The door 44 is illustrated in this manner for exemplary purposes as the present invention fully contemplates the door sliding, retracting or otherwise articulating in a manner sufficient to facilitate controlling access to the secure storage area 64 through non-hinged movements, i.e., any other movement sufficient to enable the door 44 to be positionable between the opened and closed positions.

The locking mechanism 42 may be include a structure 88 for enclosing the associated components as an essentially modular component attachable to a rearward side 90 of the door, e.g., the structure 88 may be attached with fasteners or suitable welds to the rearward side 90 of the door 44 with an opening being included through a front side of the door to facilitate interaction with the door handle 72. The structure 88 may include a plate (not shown) to enclose, cover or seal the access to the locking mechanism components such that the illustrated locking mechanism components on the rearward side 90 of the door 44 would be unseen and inaccessible when the door 40 is in the opened position. The locking mechanism components may include the first and second cams 60, 62, the handle 72, a linkage 94, a lock 96 and/or an auto-detent mechanism 98 and/or other features suitably operable in accordance with the present invention to facilitate securing the door 44 against the noted prying or wedging actions and/or against other security threats. The contemplated locking mechanism 42 is believed to be particular beneficial in this regard due to the first and second cams 60, 62 providing multiple points of engagement with the door frame 70 and/or other structure of the safe 40 that would be difficult or impossible to overcome through prying or wedging. When moving from the disengaged position (see FIG. 3) to the engaged position (see FIG. 4) while the door 44 is in the closed position, the first and second cams 60, 62 may rotate about corresponding pivots 102, 104 to provide a levering action whereby engagement mechanisms included thereon secure the door 44 to the door frame 70.

Figure 6:
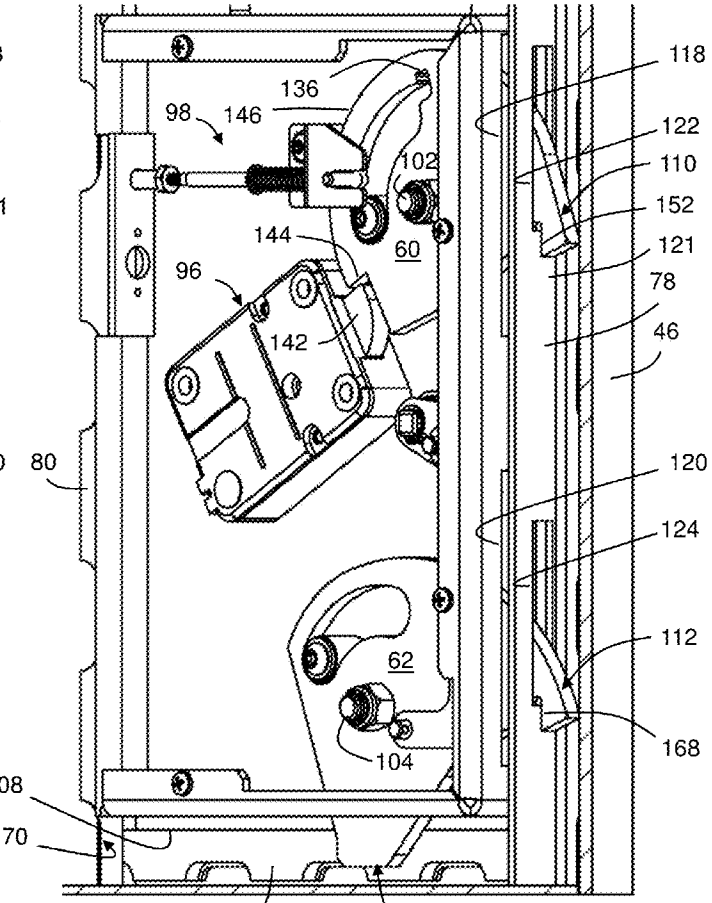
FIG. 6 illustrates a sectional view of the safe when the door is in the closed position while the locking mechanism is in the engaged position.
Figure 5:
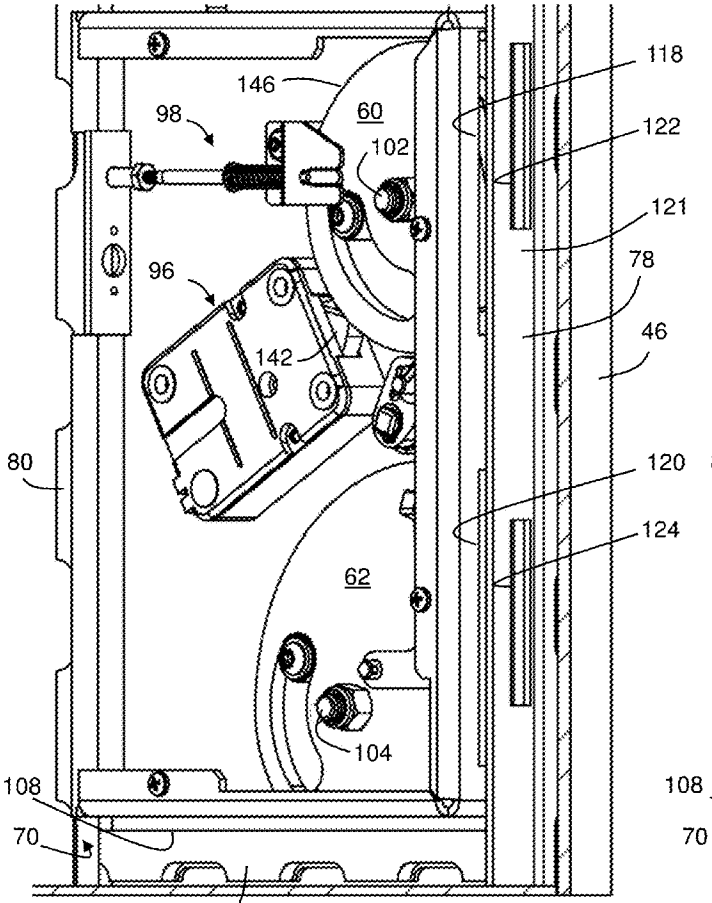
FIG. 5 illustrates a sectional view of the safe when the door is in the closed position while the locking mechanism is in the disengaged position.

FIG. 5 illustrates a sectional view of the safe 40 when the door 44 is in the closed position while the locking mechanism 42 is in the disengaged position. FIG. 6 illustrates a sectional view of the safe 40 when the door 44 is in the closed position while the locking mechanism 42 is in the engaged position. The sectional views are intended to represent an illustrative view of the door frame 70 while looking outwardly from the interior/secure storage area 64 toward the door 44, i.e., as if peering from within the safe 40 toward the door 44 while the door 44 is in the closed position. The door 44 may be shaped to cover an entirety of the opening thereto when in the closed position such that the door 44 is aligned, flushed, journaled, overlapped or otherwise positioned relative to the door frame 70 to prevent access to the secure storage area 64. The present invention fully contemplates the door frame 70 including any number of configurations, particularly configurations that may create a seam between the door 44 and the door frame 70 wherein a wedge may be inserted, and is shown for exemplary purposes with the door 44 lying flush with a front, exposed front of the door frame 70, i.e., an exposed, front face 106 of the safe 40, when in the closed position (see FIG. 2). The door 44 may swing about the hinges 82, 84 within the door jamb 70 between the opened and closed positions with rearward movement from the opened position to the closed position being arrested with a raised portion 108 of the door sill 76 (see FIGS. 3 and 4).

The raised portion 108 of the door sill 76 may be offset from the front face 106 so as to overlap part of the door 44 when the door 44 is in the closed position and to cooperate with the door frame 70 to define structural features utilized for securing the door 44. One non-limiting aspect of the present invention contemplates utilizing hooks 110, 112 included on the first and second cams 60, 62 and a foot 114 included on the second cam 62 to provide engagement mechanisms sufficient for securing the door 44 relative to the door sill 76 and the door jamb 78. The locking mechanism structure 88 may include apertures 118, 120 to permit the first and second cams 60, 62 to rotate therethrough in order to facilitate positioning the hooks 110, 112 and the foot 114 relative to the door sill 76 and the door jamb 78. The hooks 60, 62 may be shaped to grab onto or otherwise be retained against a backside of the door jamb 78 within recesses 122, 124 included in the door jamb 78 to thwart lateral forces attempting to pull the door jamb 78 away from the door 44 via a wedge driven into a seam therebetween. The foot 114 may be shaped to be positioned behind a top surface/perimeter of the raised portion 108 of the door sill 76 to provide a stop against the door 44 opening that is inaccessible to a wedge due to the raised portion 108 being overlapped by a bottom of the door 44, i.e., the overlapping raised portion 108 provides no exterior accessible seam to the foot 114.

The engagements 110, 112, 114 between the first and second cams 60, 62 and the door jamb 78 and the door sill 76 are referenced for exemplary purposes as similar engagements may be made with other features of the safe 40, e.g., the door jamb recesses 122, 124 and the raised portion 108 of the sill 76 may be included as part of the safe housing 46 and/or other structural elements may be included in the safe 40 to facilitate similar engagements, such as including recesses, latches or other reliefs in the safe 40 into which the cams 60, 62 may be engaged via the illustrated rotation or other non-rotary movement, i.e., the cams 60, 62 may be lifted or slid into and out of the illustrated engagements instead of the illustrated rotary movement. The rotation of the cams 60, 62 between the engaged and disengaged positions is believed to be particularly beneficial in ameliorating the amount space necessary to achieve the movement needed to ensure the multiple points of engagement as sliding, lifting or other motion of the cams 60, 62 into similar positions may require a larger footprint for the locking mechanism structure 88, which in comparison to the illustrated design may require a greater differential between the size of the door 88 and the size of the opening to the secure storage area 64 in order to accommodate the greater range of motion necessary to support additional, non-rotary movements.

Figure 8:
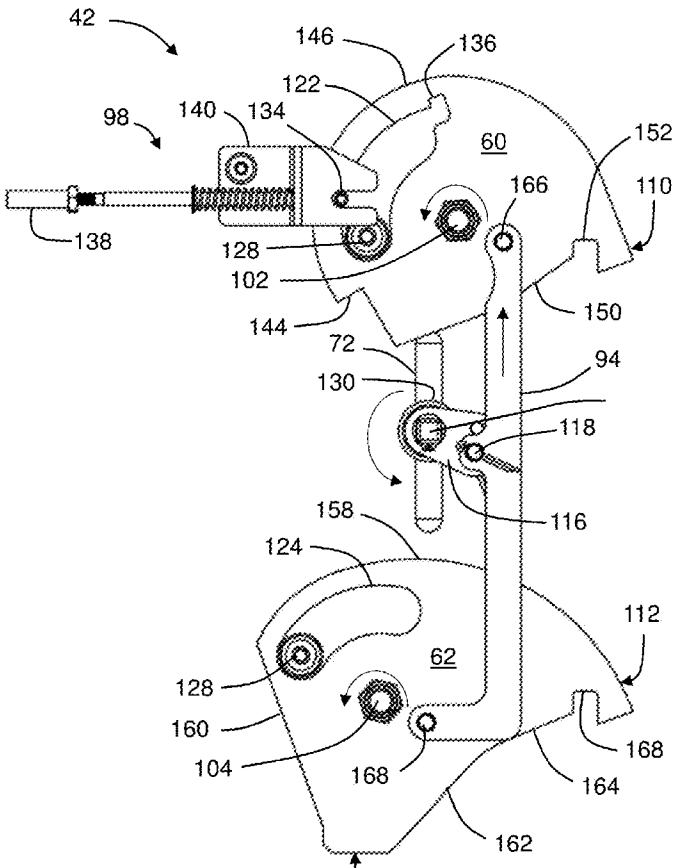
FIG. 8 illustrates a diagram associated with movement of the locking mechanism from the engaged position in accordance with one non-minting aspect of the present invention.
Figure 7:
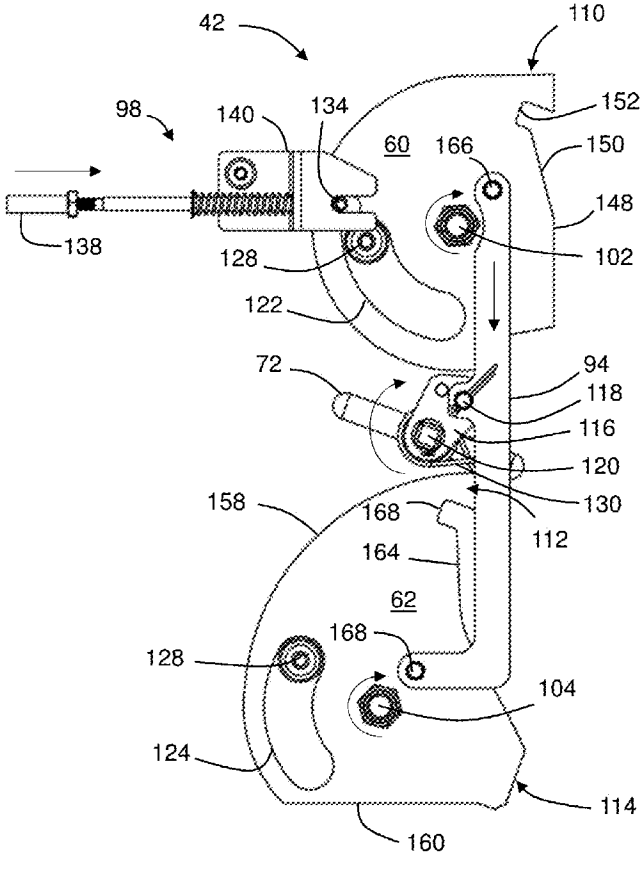
FIG. 7 illustrates a diagram associated with movement of the locking mechanism from the disengaged position in accordance with one non-limiting aspect of the present invention.

FIG. 7 illustrates a diagram associated with movement of the locking mechanism 42 from the disengaged position in accordance with one non-limiting aspect of the present invention. FIG. 8 illustrates a diagram associated with movement of the locking mechanism 42 from the engaged position in accordance with one non-minting aspect of the present invention. The diagrams include a number of reference arrows indicating movements occurring when starting from the disengaged position and thereafter moving to the engaged position (see FIG. 7) and when starting from the engaged position and thereafter moving to the disengaged position (see FIG. 8). The linkage 94 connected between the first cam 60 and the second cam 62 may be configured to facilitate concerted movement therebetween, i.e., any movement of the first cam 60 induces a corresponding movement in the second cam 62 such that the first and second cams 60, 62 move in concert. The linkage 94 may be characterized as being orientated at a first position when the first and second cams 60, 62 are in the disengaged position of FIG. 7 and as being orientated at a second position when the first and cams 60, 62 are in the engaged position FIG. 8. The linkage 94 may be connected to a bracket 116 included as part of the handle 72 with a pin 118 such that the linkage 94 moves relative to a fixed pivot 120 associated with the handle 72 when traveling between the first and second positions. The pin 118 may be configured to provide a rotatable engagement sufficient to fix rotation of the handle 72 with corresponding movement of the linkage 94, i.e., to enable the linkage 94 to articulate horizontally (e.g., leftwardly and rightwardly) and vertically (e.g., upwardly and downwardly) relative to the fixed handle pivot 120 in the illustrated manner.

The movement of first and second cams 60, 62 may be facilitated with first and second channels 122, 124 included therein and shaped to guide rotation relative to a corresponding bolt/guide 126, 128 fixed to the door 44 and/or the locking mechanism structure 88. A spring 130 may be connected between the handle bracket 116 and the pin 118 to facilitate automatically moving the locking mechanism 42 from the disengaged position to the engaged position. The spring 130 may be a torsion spring or other rotatably or non-rotatable spring operable with the handle bracket 116 and the pin 118 to force the linkage 94 from the disengaged position to the engaged position when the cams 60, 62 and the handle 72 are free to move. The auto-detent mechanism 98 may be configured to retain the locking mechanism 42 in the disengaged position against the forces generated with the spring 130 by positioning a pin 134 within a notch 136 included within the first channel 122. As shown in FIG. 3, the auto-detent mechanism 98 may include a spring-loaded push rod 138 operating with a bracket 140 fixed to the door 44 and/or the locking mechanism structure 88 to provide a spring for automatically pushing the pin 134 (see reference arrow in FIG. 7) out of engagement from the notch 136 when an end of the pin 138 extending beyond a perimeter of the locking mechanism structure 88 contacts the door jamb 80 when the door 44 is moved from the opened position to the closed position while the locking mechanism 42 is in the disengaged position.

Once the door 44 is closed and the push rod 138 disengages the notch 136 or the pin 134 is otherwise removed from the notch 136, the spring 130 may automatically transition the locking mechanism 42 from the disengaged position to the engaged position absent a contrary force being applied to the handle 72. Assuming no contrary force is applied to the handle 72, the handle 72 may rotate back to a generally vertical position and the cams 60, 62 may rotate into the engaged position shown in FIG. 4 if the door is in the opened position and into the engaged position shown in FIG. 6 if the door is in the closed position. Rotation of the handle 72 in the direction shown in FIG. 8 may thereafter move the linkage 94 from the second position to the first position absent any additional restraint on its movement in order to return the locking mechanism from the engaged position to the disengaged position. One non-limiting aspect of the present invention contemplates the locking mechanism 42 being movable in the described manner without any additional restraints on its travel between the disengaged and engaged positions, e.g., to secure an entry door without the lock 96 or additional restriction. Optionally, in the case of the locking mechanism 42 being employed with an entry door or use with devices other than a safe, the handle 72 may include a key lock or other feature (not shown) to lock its movement, and the attendant movement necessary in order to facilitate movement of the locking mechanism, until being unlocked, i.e., the key lock could be used to retain the handle 72, and thereby the linkage 94, so as to maintain the locking mechanism 42 in the disengaged and/or engaged position while locked.

The present invention is predominately described with respect to the locking mechanism 42 being employed with the above-described safe 40 whereby it is assumed that the handle 72 does not include a key lock and that the safe 40 does not include a lock accessible from an exterior of the safe 40. While the present invention fully contemplates its use and application with a safe having a door lock or a lock accessible from an exterior, it is predominately described with respect to including the lock 96 as part of the locking mechanism (see FIGS. 3-6) to facilitate securing the safe 40. The lock 96 may be an electro-mechanical device capable of being actuated between an unlocked position and a locked position in response to electronic signals received from the HMI 50 and/or a network controller in remote communication therewith (not shown). The lock 96 may include a bolt operable 142 in response to an electronically controlled solenoid or other mechanism (not shown) so as to be fixable in an extended position (see FIGS. 4 and 6) when the lock 96 is in the locked position and operable to a retracted position (see FIGS. 3 and 5) when the lock 96 is in the unlocked position. The bolt 142 may be characterized as a swing-bolt whereby the bolt 142 is essentially unmovable when in the locked position and free to swing from the locked position in response to a suitable force when in the unlocked position.

The first cam 60 may include a ledge 144 shaped to engage the bolt 142 when in the engaged position while the lock 96 is in the locked position so as to prevent the linkage 94 from moving in response to rotation of the handle 72 or other attempt to actuate the locking mechanism 42 from the engaged position to the disengaged position. The bolt 142 may thereafter be actuated to the unlocked position and swung into the retracted position in response to subsequent rotation of the handle rotation 72, i.e., to permit the locking mechanism 42 to be actuated to the disengaged position after authorization has been provided to unlock the lock 96. The lock 96 may be angled in the illustrated manner to orientate a flat side of the bolt 142 in parallel with the ledge 144 to facilitate exchanging forces therebetween sufficient for swinging the bolt 142 from the extended position to the retracted position. As the rotation of the first cam 60 continues toward the disengaged position, the ledge 144 may slide along the flat side of the bolt 142 until traveling past a tip of the bolt 142 whereupon a rear 146 of the first cam 60 continues traveling past the bolt 142 until continued rotation is arrested with the auto-detent mechanism 98 engaging the notch 136. The first cam 60 may thereafter be returned to the engaged position in the above-described manner whereby movement of the spring 130 or handle 72 causes the ledge 144 to once again pass the bolt 142 whereafter a spring or other biasing member (not shown) of the lock 96 automatically re-engages the extended/locked position to retain the locking mechanism 42.

The rear 146 of the first cam 60 is shown to be arcuate from the ledge 144 to the hook 110 with a front 148 extending therebetween is flatter. A portion 150 of the front 148 proximate a relief 152 may be angled relative to a portion of the remainder of the front 148 proximate the ledge 144 so as to provide clearance for the first recess 122 when the first cam 60 rotates therethrough. The second cam 62 may be similarly shaped as the first cam 60 insofar as including an arcuate portion 158 and multiple, flatter portions 160, 162 with an angled portion 164 proximate a relief 168 to similarly provide clearance for the second recess 124 when the second cam 62 rotates therethrough. As shown in FIGS. 5-6, the first and second cams 60, 62 rotate about corresponding pivots 102, 104 such that essentially an entirety of the first and second cams 60, 62 move within the locking mechanism structure 88 except for the portions intended to engage the door jamb 78 and the door sill 76. The first and second hooks 110, 112 are illustrated as substantially nesting within the first and second recesses 122, 124 in the same manner, i.e., approximately the same amount of hooking or engagement of the reliefs 152, 168 is generated by the first and second hooks 110, 112. The first and second recesses 122, 124 are shown to be approximately equally sized and smaller than the first and second apertures 118, 120 such that a difference in shape of the first and second cams 60, 62 results in the second cam 62 occupying less of a cross-sectional area of the second recess 124 than the first cam occupies 60 within the first recess 122 while the locking mechanism is in the engaged position.

The shaping of the first and second cams 60, 62, the length/difference in the radii of the arcuate/curved portions, the positioning of the pivots 102, 104, the linkage 94, connections pivots 166, 168 to the linkage 94, etc. may be designed in the described manner to permit the locking mechanism 42 to enable the contemplated rotational movement between the engaged and disengaged position in response to corresponding movements of the linkage 94 and handle 72. One non-limiting aspect of the present invention particularly contemplates selecting the geometries of the first and second cams 60, 62 in the illustrated proportions to permit movement of the locking mechanism 42 within a minimal footprint and such that essentially no more than the hooks 110, 112 and the foot 114 extend beyond the locking mechanism support structure 88 when in the engaged position and an entirety of those portions extending beyond the locking mechanism support structure 88 are fully retractable within the locking mechanism support structure 88 once returned to the disengaged position, i.e., hidden from view. The capability to minimally expose the locking/engagement elements of the locking mechanism 42, e.g., the hooks and foot 110, one 112, 114, is believed to be particularly beneficial in thwarting adjustments or other manipulation of the locking mechanism 42 when the door 44 is in the opened position.

As described above, one non-limiting aspect of the present invention contemplates a locking mechanism including cams articulable to provide a clever levering action whereby multiple points of engagement are provided to secure the door or other entry point against prying, wedging and related techniques intended to compromise secure by physically separating the door from a door frame or other support structure. The ability to thwart prying, wedging or other security attacks is believed to be maximized with the use of the use of two-cam locking mechanism described above, however, the present invention fully contemplates its use and application with more or less cams. A single-cam locking mechanism may be employed to enable the first hook or the second hook to provide a singular point of engagement with the door jamb or other safe structure, e.g., the first cam could be utilized without the second cam when use of the foot is unnecessary and the second cam can be utilized without the first cam, optionally with adjustment of the lock to interact the second cam, when the two-points of engagement provided with the second cam are sufficient. A multi-cam locking mechanism may also be employed whereby more than two cams are utilized, such as by including a mirrored arrangement on an opposite side of the door whereby left and right side door jamb are engaged in the manner described above.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A safe comprising:

a housing including a plurality of walls arranged to provide a secure storage area, the plurality of walls including a first sidewall, a second sidewall, a top wall, a bottom wall and a front wall, wherein the first sidewall is horizontally spaced apart from the second sidewall and the top wall is vertically spaced apart from the bottom wall, wherein the front wall includes an opening to the secure storage area and is proximate forward ends of the first sidewall, the second sidewall, the top wall and the bottom wall;

a door attached with a hinge to the front wall, the door being movable about the hinge between an opened position and a closed position, the opened position positioning the door away from the front wall to permit access to the secure storage area, the closed position positioning the door in alignment with the front wall to prevent access to the secure storage area;

a locking mechanism attached to the door, the locking mechanism including:

i) a first cam operable between an engaged position and a disengaged position, wherein a first hook included on the first cam is shaped to be positioned within a first recess included in the first sidewall such that at least a portion of the first hook overlaps at least a portion of a perimeter of the first recess when the first cam is in the engaged position while the door is in the closed position, wherein the first hook is shaped to be positioned away from the first recess such that no portion of the first hook overlaps the portion of the perimeter of the first recess when the first cam is in the disengaged position while the door is in the closed position; and ii) a lock operable between a locked position and an unlocked position, the locked position preventing movement of the first cam from the engaged position to the disengaged position, the unlocked position permitting movement of the first cam from the engaged position to the disengaged position, thereby securing access to the secure storage area when the door is in the closed position, the first cam is in the engaged position and the lock is in the locked position;

wherein the locking mechanism includes a second cam operable between the engaged position and the disengaged position, wherein a second hook included on the second cam is shaped to be positioned within a second recess included in the first sidewall such that at least a portion of the second hook overlaps at least a portion of a perimeter of the second recess when the second cam is in the engaged position while the door is in the closed position, wherein the second hook is shaped to be positioned away from the second recess such that no portion of the second hook overlaps the portion of the perimeter of the second recess when the second cam is in the disengaged position while the door is in the closed position;

wherein the locking mechanism includes a linkage for mechanically coupling the first cam with the second cam such that the first cam moves in concert with the second cam between the engaged position and the disengaged position; and wherein the second cam includes a foot, wherein the foot is shaped:

i) such that the foot extends behind or into a portion of the front wall when the second cam is in the engaged position while the door is in the closed position; and ii) such that no portion of the foot extends behind or into the front wall when the second cam is in the disengaged position while the door is in the closed position.

2. The safe of claim 1 wherein the locking mechanism includes a handle mechanically coupled with the linkage such that rotation of the handle moves the linkage between a first position and a second position, the first position being sufficient to actuate the first cam and the second cam in concert to the engaged position and the second position being sufficient to actuate the first cam and the second cam in concert to the disengaged position.

3. The safe of claim 2 wherein:

the lock includes a bolt, the bolt being fixed in an extended position when the lock is in the locked position and being operable to a retracted position when the lock is in the unlocked position; and the first cam includes a ledge shaped to engage the bolt when the first cam is in the engaged position while the lock is in the locked position, thereby preventing the linkage from moving in response to rotation of the handle.

4. The safe of claim 3 wherein the ledge engages the bolt when the first cam is in the engaged position while the lock is in the unlocked position such that subsequent rotation of the handle moves the linkage that in turn moves the first cam and thereby the ledge against the bolt whereupon the bolt begins to move from the extended position to the retracted position.

5. The safe of claim 2 wherein the locking mechanism includes:

a handle spring for biasing the linkage toward the first position when rotation of the handle moves the linkage toward the second position; and an auto-detent mechanism for retaining the linkage in the second position against the handle spring biasing, the auto-detent mechanism including a pin journaled within a channel of the first cam and a pin spring for biasing the pin against a rearward surface of the channel such that the pin automatically engages a notch at a distal end of the channel in a manner sufficient to retain the linkage in the second position against the handle spring biasing.

6. The safe of claim 5 wherein the auto detent mechanism includes a push rod attached to the pin that pushes the pin out of the notch when the door is moved from the opened position to the closed position while the cam is in the disengaged position, thereby permitting the handle spring biasing to automatically move the linkage from the second position to the first position and return the cam to the engaged position.

7. The safe of claim 1 wherein the first cam includes a foot, wherein the foot is shaped:

such that the foot extends behind or into a portion of the front wall when the first cam is in the engaged position while the door is in the closed position; and such that no portion of the foot extends behind or into the front wall when the cam is in the disengaged position while the door is in the closed position.

8. A locking mechanism for securing a door when mounted to a door frame, the door frame including a door jamb between a door header and a door sill and the door being operable therein between an opened position and a closed position, the locking mechanism comprising:

a first cam operable between an engaged position and a disengaged position, wherein the first cam includes a first hook shaped to:

i) to overlap a back side of the door jamb via a first opening included therein when the first cam is in the engaged position while the door is in the closed position, the back side of the door jamb being opposite to a front side of the door jamb interfacing with the door; and ii) disengage from the first opening when the first cam is in the disengaged position while the door is in the closed position;

a second cam operable between the engaged position and the disengaged position, wherein the second cam includes a second hook shaped to:

i) to overlap the back side of the door jamb via a second opening included therein when the second cam is in the engaged position while the door is in the closed position; and ii) disengage from the second opening when the second cam is in the disengaged position while the door is in the closed position;

a linkage for mechanically coupling the first cam with the second cam such that the first cam moves in concert with the second cam between the engaged position and the disengaged position;

a handle mechanically coupled with the linkage such that movement of the handle induces corresponding movement in the linkage, and thereby, the first and second cams, wherein the handle is configured to permit movement sufficient to operate the first and second cams from the engaged position to the disengaged position; and wherein the second cam includes a foot, wherein the foot is shaped:

i) such that the foot extends behind a portion of the door sill or within a door sill recess included therein when the second cam is in the engaged position while the door is in the closed position; and ii) such that no portion of the foot extends behind or within the door sill when the second cam is in the disengaged position while the door is in the closed position.

9. The locking mechanism of claim 8 further comprising:

a first pivot for pivotally attaching the first cam relative to the door;

a second pivot for pivotally attaching the second cam relative to the door; and wherein the linkage simultaneously rotates the first and second cams about the first and second pivots when moving from the engaged position to the disengaged position in response to corresponding movement of the handle.

10. The locking mechanism claim 9 wherein:

the first hook is shaped to provide a first relief sufficient to permit the first cam to rotate into the first opening when moving from the disengaged position to the engaged position such that substantially an entire length of the first relief is positioned below the first opening when the engaged position is reached; and the second hook is shaped to provide a second relief sufficient to permit the second cam to rotate into the second opening when moving from the disengaged position to the engaged position such that substantially an entire length of the second relief is positioned below the second opening when the engaged position is reached.

11. The locking mechanism of claim 10 further comprising a lock operable between an unlocked position and a locked position, the lock including a bolt positioned relative to at least one of the first and second cams, the linkage and the handle such that the bolt blocks rotation of the first and second cams from the engaged position to the disengaged position when the lock is in the locked position and such that the bolt does not block rotation of the first and second cams from the engaged position to the disengaged position when the lock is in the unlocked position.

12. The locking mechanism of claim 11 wherein:

the lock is positioned relative to the first cam; and the first cam includes a ledge shaped to engage the bolt, the shape being sufficient for preventing movement of the first cam to the disengaged position when the first cam is in the engaged position while the lock is in the locked position.

13. The locking mechanism of claim 12 wherein the door frame is included as part of a safe configured for securing a cassette within a secure storage area accessible through the door.

14. A safe comprising:

a housing including a plurality of walls arranged to provide a secure storage area, the plurality of walls including a first sidewall, a second sidewall, a top wall, a bottom wall and a front wall, wherein the first sidewall is horizontally spaced apart from the second sidewall and the top wall is vertically spaced apart from the bottom wall, wherein the front wall includes an opening to the secure storage area and is proximate forward ends of the first sidewall, the second sidewall, the top wall and the bottom wall;

a door attached with a hinge to the front wall, the door being movable about the hinge between an opened position and a closed position, the opened position positioning the door away from the front wall to permit access to the secure storage area, the closed position positioning the door in alignment with the front wall to prevent access to the secure storage area; and a locking mechanism attached to the door, the locking mechanism including:

i) a first cam operable between an engaged position and a disengaged position, wherein a first hook included on the first cam is shaped to be positioned within a first recess included in the first sidewall such that at least a portion of the first hook overlaps at least a portion of a perimeter of the first recess when the first cam is in the engaged position while the door is in the closed position, wherein the first hook is shaped to be positioned away from the first recess such that no portion of the first hook overlaps the portion of the perimeter of the first recess when the first cam is in the disengaged position while the door is in the closed position; and ii) a lock operable between a locked position and an unlocked position, the locked position preventing movement of the first cam from the engaged position to the disengaged position, the unlocked position permitting movement of the first cam from the engaged position to the disengaged position, thereby securing access to the secure storage area when the door is in the closed position, the first cam is in the engaged position and the lock is in the locked position wherein the locking mechanism includes a second cam operable between the engaged position and the disengaged position, wherein a second hook included on the second cam is shaped to be positioned within a second recess included in the first sidewall such that at least a portion of the second hook overlaps at least a portion of a perimeter of the second recess when the second cam is in the engaged position while the door is in the closed position, wherein the second hook is shaped to be positioned away from the second recess such that no portion of the second hook overlaps the portion of the perimeter of the second recess when the second cam is in the disengaged position while the door is in the closed position;

wherein the locking mechanism includes a linkage for mechanically coupling the first cam with the second cam such that the first cam moves in concert with the second cam between the engaged position and the disengaged position;

wherein the locking mechanism includes a handle mechanically coupled with the linkage such that rotation of the handle moves the linkage between a first position and a second position, the first position being sufficient to actuate the first cam and the second cam in concert to the engaged position and the second position being sufficient to actuate the first cam and the second cam in concert to the disengaged position; and wherein the locking mechanism includes:

i) a handle spring for biasing the linkage toward the first position when rotation of the handle moves the linkage toward the second position; and ii) an auto-detent mechanism for retaining the linkage in the second position against the handle spring biasing, the auto-detent mechanism including a pin journaled within a channel of the first cam and a pin spring for biasing the pin against a rearward surface of the channel such that the pin automatically engages a notch at a distal end of the channel in a manner sufficient to retain the linkage in the second position against the handle spring biasing.

15. The safe of claim 14 wherein:

the lock includes a bolt, the bolt being fixed in an extended position when the lock is in the locked position and being operable to a retracted position when the lock is in the unlocked position; and the first cam includes a ledge shaped to engage the bolt when the first cam is in the engaged position while the lock is in the locked position, thereby preventing the linkage from moving in response to rotation of the handle.

16. The safe of claim 15 wherein the ledge engages the bolt when the first cam is in the engaged position while the lock is in the unlocked position such that subsequent rotation of the handle moves the linkage that in turn moves the first cam and thereby the ledge against the bolt whereupon the bolt begins to move from the extended position to the retracted position.

17. The safe of claim 14 wherein the auto detent mechanism includes a push rod attached to the pin that pushes the pin out of the notch when the door is moved from the opened position to the closed position while the cam is in the disengaged position, thereby permitting the handle spring biasing to automatically move the linkage from the second position to the first position and return the cam to the engaged position.

18. The safe of claim 14 wherein the first cam includes a foot, wherein the foot is shaped:

such that the foot extends behind or into a portion of the front wall when the first cam is in the engaged position while the door is in the closed position; and such that no portion of the foot extends behind or into the front wall when the cam is in the disengaged position while the door is in the closed position.

* * * * *